US007718118B2

(12) United States Patent
Bronfin et al.

(10) Patent No.: US 7,718,118 B2
(45) Date of Patent: May 18, 2010

(54) CREEP RESISTANT MAGNESIUM ALLOY WITH IMPROVED DUCTILITY AND FRACTURE TOUGHNESS FOR GRAVITY CASTING APPLICATIONS

(75) Inventors: Boris Bronfin, Beer Sheva (IL); Nir Moscovitch, Beer Sheva (IL); Mark Katzir, Beer Sheva (IL); Soenke Schumann, Schwuelper (DE); Rudolph Boehm, Seelze (DE)

(73) Assignee: Dead Sea Magnesium Ltd., Beer-Sheva (IL)

( * ) Notice: Subject to any disclaimer, the term of this patent is extended or adjusted under 35 U.S.C. 154(b) by 213 days.

(21) Appl. No.: 11/525,691

(22) Filed: Sep. 22, 2006

(65) Prior Publication Data

US 2008/0041500 A1 Feb. 21, 2008

(30) Foreign Application Priority Data

Aug. 17, 2006 (IL) ..... 177568

(51) Int. Cl.
*C22C 23/06* (2006.01)

(52) U.S. Cl. ..... 420/406; 148/406; 148/420

(58) Field of Classification Search ..... 148/406, 148/420, 666, 667; 420/402–414
See application file for complete search history.

(56) References Cited

U.S. PATENT DOCUMENTS 3,419,385 A * 12/1968 Foerster et. al. ..... 420/404
4,116,731 A 9/1978 Tikhova et al.
4,194,908 A * 3/1980 Unsworth et al. ..... 148/406
6,193,817 B1 * 2/2001 King et al. ..... 148/420
7,048,812 B2 5/2006 Bettles et al.
2003/0129074 A1 * 7/2003 Bronfin et al. ..... 420/406

FOREIGN PATENT DOCUMENTS

EP 1329530 7/2003
WO WO 2004/001087 A1 * 12/2003
WO WO 2005/035811 A1 * 4/2005

OTHER PUBLICATIONS

E. Aghion et al, Effect of yttirum addition on the properties of grain-refined Mg-3%ND alloy, Journal of Materials Science, (2008), vol. 43, p. 4870-4875.*
B. Bronfin and N. Moscovitch, New magnesium alloys for transmission parts, Metal Science and Heat Treatment, (2006), vol. 48, No. 11-12, p. 10-18.*
S. Ramati, Integrated design and product development for the eco-efficient production of low-weight airplane equipment: Magnesium castings for aeroplanes, Aeronautics Days, Vienna, Austria, Jun. 19-21, 2006, p. 1-24.*

* cited by examiner

*Primary Examiner*—George Wyszomierski
*Assistant Examiner*—Mark L Shevin
(74) *Attorney, Agent, or Firm*—Kinney & Lange, P.A.

(57) ABSTRACT

The present invention relates to creep-resistant magnesium-based alloys with low susceptibility to hot tearing, and with improved ductility, impact strength and fracture toughness, and corrosion resistance. The alloys contain at least 96 wt % magnesium, 1.5 to 1.9 wt % neodymium, 0.10 to 0.30 wt % yttrium, 0.35 to 0.70 wt % zirconium, 0.05 to 0.35 wt % zinc, 0.01 to 0.10 wt % calcium, 0.01 to 0.15 wt % strontium, and 0.0000 to 0.0005 wt % beryllium, and they are suitable for low pressure and gravity castings. Articles, that are castings of the alloys, are suitable for applications at temperatures as high as 175-250° C.

14 Claims, 4 Drawing Sheets

Table 1 Chemical compositions of alloys

| Alloy | Zn % | Zr % | Nd % | RE* % | Y % | Ca % | Sr % | Be % | Si % | Fe % | Cu % | Ni % |
|---|---|---|---|---|---|---|---|---|---|---|---|---|
| Example 1 | 0.25 | 0.44 | 1.6 | - | 0.12 | 0.01 | 0.02 | - | 0.005 | 0.005 | 0.0008 | 0.0007 |
| Example 2 | 0.15 | 0.41 | 1.9 | - | 0.22 | 0.03 | 0.01 | 0.0005 | 0.005 | 0.004 | 0.0009 | 0.0008 |
| Example 3 | 0.32 | 0.52 | 1.7 | - | 0.15 | 0.10 | 0.14 | - | 0.006 | 0.004 | 0.0010 | 0.0006 |
| Example 4 | 0.12 | 0.35 | 1.8 | - | 0.24 | 0.01 | 0.08 | - | 0.004 | 0.003 | 0.0008 | 0.0008 |
| Example 5 | 0.21 | 0.40 | 1.5 | - | 0.17 | 0.08 | 0.01 | 0.003 | 0.006 | 0.004 | 0.0009 | 0.0007 |
| Example 6 | 0.12 | 0.48 | 1.9 | - | 0.12 | 0.02 | 0.15 | - | 0.004 | 0.005 | 0.0008 | 0.0006 |
| Example7 | 0.33 | 0.61 | 1.7 | 0.03 | 0.14 | 0.01 | 0.02 | - | 0.003 | 0.004 | 0.0008 | 0.0007 |
| Comparative Example 1 | 0.35 | 0.45 | - | 2.9 | - | - | - | - | 0.02 | 0.007 | 0.0021 | 0.0010 |
| Comparative Example 2 | 0.5 | 0.42 | 1.6 | 1.0 | - | - | - | - | 0.008 | 0.005 | 0.0014 | 0.0009 |
| Comparative Example 3 | 0.35 | 0.45 | 2.9 | - | 0.15 | 0.02 | - | - | 0.005 | 0.005 | 0.0009 | 0.0008 |
| Comparative Example 4 | 0.45 | 0.38 | 2.0 | - | 0.90 | - | - | - | 0.03 | 0.01 | 0.01 | 0.0009 |
| Comparative Example 5 | 0.05 | 0.44 | 1.3 | - | 0.05 | - | 0.06 | - | 0.006 | 0.006 | 0.0011 | 0.0007 |
| Comparative Example 6 | 0.18 | 0.45 | 1.6 | 0.15 | 0.16 | 0.02 | 0.03 | - | 0.007 | 0.006 | 0.0021 | 0.0006 |
| Comparative Example 7 | 4.1 | 0.65 | - | 1.2 | - | - | - | - | 0.007 | 0.006 | 0.0021 | 0.0007 |

*Cerium based mishmetal

Table 1 Chemical compositions of alloys

| Alloy | Zn % | Zr % | Nd % | RE* % | Y % | Ca % | Sr % | Be % | Si % | Fe % | Cu % | Ni % |
|---|---|---|---|---|---|---|---|---|---|---|---|---|
| Example 1 | 0.25 | 0.44 | 1.6 | - | 0.12 | 0.01 | 0.02 | - | 0.005 | 0.005 | 0.0008 | 0.0007 |
| Example 2 | 0.15 | 0.41 | 1.9 | - | 0.22 | 0.03 | 0.01 | 0.0005 | 0.005 | 0.004 | 0.0009 | 0.0008 |
| Example 3 | 0.32 | 0.52 | 1.7 | - | 0.15 | 0.10 | 0.14 | - | 0.006 | 0.004 | 0.0010 | 0.0006 |
| Example 4 | 0.12 | 0.35 | 1.8 | - | 0.24 | 0.01 | 0.08 | - | 0.004 | 0.003 | 0.0008 | 0.0008 |
| Example 5 | 0.21 | 0.40 | 1.5 | - | 0.17 | 0.08 | 0.01 | 0.003 | 0.006 | 0.004 | 0.0009 | 0.0007 |
| Example 6 | 0.12 | 0.48 | 1.9 | - | 0.12 | 0.02 | 0.15 | - | 0.004 | 0.005 | 0.0008 | 0.0006 |
| Example7 | 0.33 | 0.61 | 1.7 | 0.03 | 0.14 | 0.01 | 0.02 | - | 0.003 | 0.004 | 0.0008 | 0.0007 |
| Comparative Example 1 | 0.35 | 0.45 | - | 2.9 | - | - | - | - | 0.02 | 0.007 | 0.0021 | 0.0010 |
| Comparative Example 2 | 0.5 | 0.42 | 1.6 | 1.0 | - | - | - | - | 0.008 | 0.005 | 0.0014 | 0.0009 |
| Comparative Example 3 | 0.35 | 0.45 | 2.9 | - | 0.15 | 0.02 | - | - | 0.005 | 0.005 | 0.0009 | 0.0008 |
| Comparative Example 4 | 0.45 | 0.38 | 2.0 | - | 0.90 | - | - | - | 0.03 | 0.01 | 0.01 | 0.0009 |
| Comparative Example 5 | 0.05 | 0.44 | 1.3 | - | 0.05 | - | 0.06 | - | 0.006 | 0.006 | 0.0011 | 0.0007 |
| Comparative Example 6 | 0.18 | 0.45 | 1.6 | 0.15 | 0.16 | 0.02 | 0.03 | - | 0.007 | 0.006 | 0.0021 | 0.0006 |
| Comparative Example 7 | 4.1 | 0.65 | - | 1.2 | - | - | - | - | 0.007 | 0.006 | 0.0021 | 0.0007 |

*Cerium based mishmetal

Fig. 1

Table 2 Susceptibility to hot tearing

| Alloy | Ring width at hot tearing ring test [mm] | Minimum CRC mold temperature allowing crack free casting [°C] | Ingot casting without protective atmosphere | Oxidation resistance ranking * | Melt loss [%] |
|---|---|---|---|---|---|
| Example 1 | 5 | 300 | + | 1 | 1.8 |
| Example 2 | 7.5 | 310 | + | 1 | 2.0 |
| Example 3 | 7.5 | 300 | + | 1 | 1.9 |
| Example 4 | 5 | 310 | + | 1 | 1.7 |
| Example 5 | 5 | 320 | + | 1 | 1.8 |
| Example 6 | 7.5 | 315 | + | 1 | 1.9 |
| Example 7 | 5 | 315 | + | 1 | 1.9 |
| Comparative Example 1 | 15 | 380 | - | 4 | 3.2 |
| Comparative Example 2 | 15 | 380 | - | 3 | 3.3 |
| Comparative Example 3 | 12.5 | 360 | + | 1 | 2.0 |
| Comparative Example 4 | 15 | 370 | + | 1 | 1.9 |
| Comparative Example 5 | 15 | 340 | - | 3 | 2.4 |
| Comparative Example 6 | 10 | 350 | + | 3 | 2.1 |
| Comparative Example 7 | 40 | > 400 | - | 5 | 3.4 |

* 1-the best, 5- the worst

Fig. 4

Table 3 Mechanical properties of new alloys

| Alloy | TYS [MPa] | UTS [MP] | E [%] | Impact strength [J] | Fracture Toughness $K_{Ic}$ [MPa.m $^{0.5}$] | Corrosion rate [mg/cm$^2$/day] | MCR · $10^{-10}$[$s^{-1}$] | |
|---|---|---|---|---|---|---|---|---|
| | | | | | | | 175°C, 120 MPa | 200°C, 90 MPa |
| Example 1 | 125 | 232 | 13 | 9 | 24 | 0.12 | 1.2 | 2.3 |
| Example 2 | 135 | 240 | 10 | 8 | 21 | 0.15 | 0.9 | 1.9 |
| Example 3 | 130 | 235 | 12 | 9 | 23 | 0.14 | 1.1 | 2.4 |
| Example 4 | 135 | 238 | 11 | 9 | 22 | 0.16 | 1,2 | 2.4 |
| Example 5 | 126 | 234 | 14 | 10 | 25 | 0.14 | 1.2 | 2.2 |
| Example 6 | 135 | 245 | 11 | 8 | 22 | 0.15 | 1.1 | 2.0 |
| Example 7 | 140 | 248 | 11 | 9 | 21 | 0.14 | 1.0 | 2.2 |
| Comparative Example 1 | 112 | 202 | 3 | 4 | 14 | 0.45 | 4.6 | 5.8 |
| Comparative Example 2 | 125 | 205 | 4 | 4 | 14 | 0.35 | 3.8 | 4.9 |
| Comparative Example 3 | 154 | 245 | 7 | 5 | 17 | 0.16 | 0.9 | 1.9 |
| Comparative Example 4 | 139 | 225 | 4 | 5 | 15 | 0.88 | 1.0 | 2.3 |
| Comparative Example 5 | 95 | 220 | 8 | 8 | 19 | 0.24 | 4.4 | 6.1 |
| Comparative Example 6 | 120 | 210 | 6 | 5 | 16 | 0.19 | 1.4 | 2.6 |
| Comparative Example 7 | 135 | 220 | 4 | 3 | 14 | 3.5 | 456 | 887 |

Fig. 5

CREEP RESISTANT MAGNESIUM ALLOY WITH IMPROVED DUCTILITY AND FRACTURE TOUGHNESS FOR GRAVITY CASTING APPLICATIONS

FIELD OF THE INVENTION

The present invention relates to creep-resistant magnesium-based alloys with low susceptibility to hot tearing, with improved ductility, fracture toughness, and corrosion resistance, suitable for applications at temperatures as high as 175-250° C.

BACKGROUND OF THE INVENTION

Magnesium alloys have the lowest density of common engineering metals and therefore they are becoming more and more attractive for various automotive applications. The use of magnesium alloys for power train applications not only significantly reduces the overall vehicle weight, but it also contributes to desired rebalancing of the weight distribution by reducing the weight at the front of the car. This results in improving vehicle dynamics and in creating a commercially attractive product. The manufacturers, therefore, strive to introduce magnesium alloys into power train components, such as gearbox housing, oil pan, transfer case, crankcase, oil pump housing, transmission stator, intake manifold, and others. In addition there are some power train components, e.g. engine cradle and control arm, that require, in addition to good creep behavior, also good properties associated with energy absorption, such as impact strength and fracture toughness, and further also good ductility. A new, cost effective, magnesium alloy with such properties would resolve several critical issues that limit the large-scale application of magnesium castings in the automotive industry. Existing creep resistant alloys, used in high-pressure die casting, are not suitable for large and heavy components, such as engine blocks, which should rather be produced by gravity casting (sand or permanent mold), or by low-pressure casting (sand or permanent mold). Furthermore, there are several power train components, like engine cradle, lower control arm, etc., requiring materials having not only good creep resistance, but also improved energy-absorption properties and ductility.

The strategy of developing gravity casting alloys differs significantly from that for high-pressure die casting alloys. The major mechanisms underlying the properties of high-pressure die casting alloys, comprise strengthening solid solutions due to specific alloying elements, and strengthening grain boundaries due to the rapid cooling under solidification. The stable intermetallics, precipitating during the solidification process, have a eutectic nature and are relatively coarse. On the other hand, the major mechanisms that affect properties of creep resistant gravity casting alloys comprise hardening during the precipitation, and grain boundary strengthening. Thus, when developing creep resistant magnesium alloys for gravity casting, several principles should be taken into consideration. The solid solubility in magnesium of the main alloying elements should be good, and should sharply decrease as the temperature decreases down to ambient temperature. This will enable a marked response to aging. Solubility limits for binary magnesium alloys can be found in "Phase Diagrams of Binary Magnesium Alloy" (eds. A. A. Nayeb-Hashemi and J. B. Klark, Metals Park, Ohio, 1988). Solute atoms should have a low diffusion coefficient in the matrix, to provide strong interatomic bonds and to form the solid solution, which has no response to aging under the working conditions. Good properties at elevated temperatures require thermal stability of the intermetallic compounds, which should have good coherency with the matrix, thus strengthening grain boundaries and effectively forming obstacles against the deformation. The melting point of the precipitate is a good indication of its thermal stability. The first precipitates to nucleate are very often metastable and coherent with the matrix, providing excellent precipitation hardening. As aging progresses, metastable precipitates are transformed into stable equilibrium phases. The morphology of the precipitates is the major factor which affects both ambient strength and creep resistance.

Heat treatment is a very important factor for achieving a required combination of service properties, and should be employed. Solid solution treatment should be performed at the highest practicable temperature to dissolve coarse eutectic intermetallic phases formed during casting process. Selecting the precise temperature and time of aging is an important task because these parameters significantly affect the final properties. In addition to their influence on mechanical properties and creep behavior, alloying elements should provide good castability (increased fluidity, low susceptibility to hot cracking, reduced porosity and greater casting integrity), further in combination with improved corrosion resistance and affordable cost. The development of new alloys usually requires to take into consideration both the desired performance and the affordable cost.

The gravity casting magnesium alloy ML11, developed in the former USSR, has been used for many years for applications at temperatures up to 200° C. This alloy contains 0.2-0.7 wt % Zn, 0.4-1.0 wt % Zr, 2.5-4.0 wt % RE, Ce-based mishmetal (typically containing 50 wt % Ce, 25 wt % La, 20 wt % Nd, 5 wt % Pr) with maximal impurity levels of (in wt %): Fe-0.01, Ni-0.005, Cu-0.03, Si-0.03, and Al-0.02. ML11 has relatively good creep resistance but exhibits very low ductility and impact strength as well as only moderate corrosion resistance.

U.S. Pat. No. 6,193,817 discloses magnesium-based alloy containing 0.1-2.0 wt % Zn, 2.1-5.0 wt % RE other than Y, up to 0.4 wt % of a combination of at least two elements chosen from the group consisting of Zr, Hf and Ti, and optionally up to 0.5 wt % Mn and up to 0.5 wt % Ca. This alloy has properties and disadvantages similar to those of ML11, with rather improved corrosion behavior.

U.S. Pat. No. 7,048,812 describes magnesium-based casting alloys containing 0.4-0.7 wt % Zn, 0.3-1.0 wt % Zr, 0.8-1.2 wt % RE (Ce based mishmetal), 1.4-1.9 wt % Nd. In fact this alloy is very similar to ML11 and the alloys of U.S. Pat. No. 6,193,817.

All these materials exhibit adequate creep behavior but have very low ductility, and energy-absorption properties. In addition, the above alloys are prone to hot tearing in the case of permanent mold casting technology.

U.S. Pat. No. 4,116,731 describes heat treated and aged magnesium based alloy containing 0.8-6.0 wt % Y, 0.5-4.0 wt % Nd, 0.1-2.2 wt % Zn, 0.3-1.1 wt % Zr, up to 0.05% Cu, and up to 0.2% Mn. Due to relatively wide concentration ranges claimed by the above patent, the alloys exhibit very diverse properties. However, all of them are prone to hot tearing under permanent mold casting, and exhibit poor corrosion behavior, low ductility and fracture toughness.

EP 1,329,530 discloses magnesium-based casting alloys containing 0.2-0.8 wt % Zn, 0.2-0.8 wt % Zr, 2.7-3.3 wt % Nd, 0.0-2.6 wt % Y, and 0.03-0.25% Ca. The alloys exhibit high strength and high creep resistance, but their ductility, and energy-absorption properties are not sufficient for engine cradle applications; furthermore, the alloys are relatively expensive and require high mold temperatures in order to avoid hot tearing formation under casting, especially when casting items having complicated geometries.

It is therefore an object of this invention to provide magnesium alloys suitable for permanent mold casting application, and to enable crack-free, not expensive, casting at mold temperatures as low as 300-320° C.

It is an object of this invention to provide magnesium-based alloys having high ductility and fracture toughness, as well as capability to operate at 200° C. for a long time.

It is another object of the present invention to provide alloys, which exhibit excellent combination of ductility, impact strength and fracture toughness, creep resistance, and corrosion resistance.

It is still a further object of this invention to provide alloys which exhibit the aforesaid behavior and properties, and have a relatively low cost.

Other objects and advantages of the present invention will appear as the description proceeds.

SUMMARY OF THE INVENTION

The present invention provides creep-resistant magnesium-based alloys designated for applications at temperatures as high as 175-200° C., which exhibit improved ductility, fracture toughness, and castability, combined with good corrosion resistance. The alloy according to the invention contains at least 96 wt % magnesium, 1.5 to 1.9 wt % neodymium, 0.10 to 0.30 wt % yttrium, 0.35 to 0.70 wt % zirconium, 0.05 to 0.35 wt % zinc, 0.02 to 0.10 wt % calcium, 0.02 to 0.15 wt % strontium, and optionally beryllium up to 0.0005 wt %. In a preferred embodiment of the invention, the sum of Ce and La in said alloy is not greater than 0.1 wt %. Said alloy additionally contains up to 0.006 wt % iron, up to 0.001 wt % nickel, up to 0.002 wt % copper, and up to 0.008 wt % silicon, and possibly incidental impurities. The alloy of the invention exhibits low susceptibility to hot tearing which enables crack-free permanent mold casting even at temperatures as low as 300-320° C. The alloys exhibit high ductility, impact strength and fracture toughness, and creep resistance in response to accelerated T6 heat treatment comprising solid solution heat treatment at 530-570° C. for 3 to 7 hours followed by cooling in a quenching medium and by subsequent aging at 220-260° C. for 2 to 7 hours. An alloy according to the invention preferably exhibits room temperature elongation to rupture minimally about 10%, impact strength minimally 8 J, and fracture toughness minimally 21 $MPa.m^{0.5}$. The alloys according to the invention retain high creep resistance up to 200° C. Said alloys exhibit minimum creep rate (MCR) at 200° C. under stress of 90 MPa of not more than $2.4\times10^{-10}$-$s^{-1}$. Said alloys further exhibit average corrosion rate, measured by the salt spray test as per ASTM Standard B-117, of less than 0.17 $mg/cm^2$/day. The alloys of the invention are suitable for low pressure casting and for gravity casting. Said gravity casting is preferably permanent mold casting. The alloys are further suitable for applications at temperatures of up to 200° C.

The invention is also directed to an article which is a casting of the magnesium alloys described hereinbefore. Said casting is preferably selected from the group consisting of permanent mold casting, low-pressure permanent mold casting, sand casting, low-pressure sand casting, investment casting, and low-pressure investment casting. An article according to the invention has been preferably subjected to accelerated T6 heat treatment comprising solid solution heat treatment at 530-570° C. for 3 to 7 hrs, followed by cooling in a quenching medium and by subsequent aging at 220-260° C. for 2 to 7 h. Preferably said treatment comprises solid solution heat treatment at 545° C. for 4 to 6 hours, followed by cooling in a quenchant and by subsequent aging at 250° C. for 2 to 4 hours. Said article is suitable for applications at temperatures of up to 200° C.

BRIEF DESCRIPTION OF THE DRAWINGS

The above and other characteristics and advantages of the invention will be more readily apparent through the following examples, and with reference to the appended drawings, wherein:

FIG. 1. is Table 1, showing chemical compositions of alloys of Examples 1-7 and Comparative Examples 1-7;

FIG. 4. is Table 2, showing hot tearing properties of the alloys of Examples 1-7 and Comparative Examples 1-7; and FIG. 5. is Table 3, showing mechanical properties of the alloys of Examples 1-7 and Comparative Examples 1-7.

DETAILED DESCRIPTION OF THE INVENTION

Figure 2:
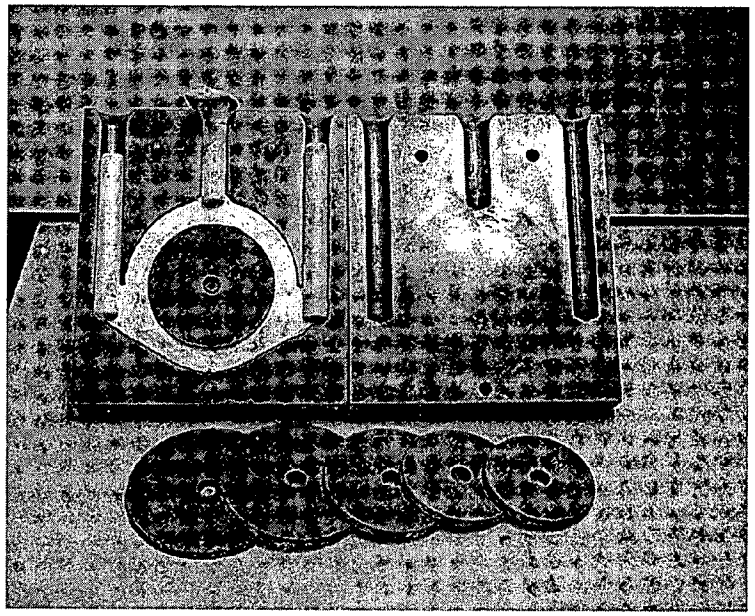
FIG. 2. shows ring hot tearing mold.

Permanent mold casting or gravity die casting employs metal molds in which molten alloy is poured by gravity or low pressure. The permanent mold casting has the lowest per-part-cost of any casting process in limited production runs, but it can be adjusted also for runs comprising thousands of parts.

However, the permanent mold casting is not regularly employed for magnesium alloys, because most of known magnesium alloys are not suitable for this process. The use of metallic molds leads to molten metal constraint in the course of solidification, resulting in the formation of hot tearing defects due to the inability of the cast to shrink freely when cooled. The susceptibility to hot tearing largely depends on the alloy composition, the part design, and the casting parameters, particularly temperature of the mold. Increasing the mold temperature up to 450° C. may suppress the hot tearing formation, but it results in the creation of coarse microstructure, in deterioration of mechanical properties, and in reduction of the mold lifetime. Thus, new alloy compositions are required that would allow to cast the parts with complicated geometry at mold temperatures not higher than 300-320° C. It has now been found that certain combinations of elements in magnesium-based alloys, comprising zinc, zirconium, neodymium, yttrium, strontium, and calcium confer superior properties to the alloys. These properties include good castability—particularly low susceptibility to hot tearing, high ductility, impact strength and fracture toughness, combined with good creep and corrosion resistance.

Magnesium-based alloys of the present invention contain 1.5 to 1.9 wt % neodymium. If the Nd content is less than 1.5 wt %, the alloy will have insufficient strength at ambient temperatures and will be prone to oxidation and burning in the molten state. On the other hand, Nd content higher than 1.9 wt % will lead to reduced ductility and fracture toughness of the alloy due to excess of intermetallic compounds. An alloy according to the present invention contains 0.1 to 0.3 wt % yttrium. Yttrium content less than 0.1 wt % results in increased oxidation, and in increased susceptibility to burning during molten metal handling at 750-780° C. On the other hand, increasing the yttrium content to more than 0.3 wt % may result in reduced ductility, and in reduced fracture toughness, and further it increases the alloy cost. Nd and Y are alloying elements, enabling the alloy to attain a significant precipitation hardening after the full T6 heat treatment. The alloys of the present invention are grain refined by zirconium that also enhances the corrosion resistance of the alloy, and prevents porosity in castings. It has been found that 0.35 wt % of zirconium is sufficient for grain refining. The upper limit for the zirconium content is 0.7 wt % due to its limited solubility in liquid magnesium. The alloy of this invention contains from 0.05 to 0.35 wt % zinc, which imparts to it improved castability, particularly fluidity. At higher Zn contents, the most of Y and Nd is bound as a stable Zn—Y—Nd eutectic intermetallic compound, insoluble in solid magnesium, thus suppressing the alloy's response to the aging. The alloys of this invention further contain Sr from 0.01 to 0.15% and calcium from 0.01 wt % to 0.10 wt %, as oxidation inhibitors, optionally accompanied by up to 0.0005 wt % of beryllium. The strontium and calcium content are preferably lower than 0.05 wt % each in order to prevent possible porosity problems. The beryllium content is preferably lower than 0.0003 wt % thus preventing grain coarsening. The alloys of the present invention should not contain more than 0.1 wt % Ce and/or La. The presence of the above elements in the sum concentrations higher than 0.1% leads to a significant reduction of ductility, impact strength and fracture toughness due to the formation during solidification of coarse intermetallics that are insoluble at the solid solution heat treatment. Silicon is a typical impurity that may be present in the magnesium alloys, however, its content in the alloys of the invention should not exceed 0.008 wt %, and preferably it should be lower than 0.005 wt %. Iron, copper and nickel deteriorate the corrosion resistance of magnesium alloys. Therefore, the alloys of this invention do not contain more than 0.006 wt % iron, 0.002 wt % copper, and 0.001 wt % nickel, and preferably they contain less than 0.005 wt % Fe, 0.0015 wt % Cu, and 0.0008 wt % Ni.

The magnesium alloys of the instant invention have been tested and compared with comparative samples, including widely used commercially available magnesium-based alloys ZE41 and ML11. The alloys were prepared in a 120-liter crucible made of low carbon steel and cast into 12-kg ingots. The mixture of $CO_2$+0.5% $SF_6$ was used as a protective atmosphere. The results show that the new alloys exhibit better oxidation resistance and lower susceptibility to hot tearing than comparative alloys. Neither burning nor oxidation was observed on the surface of ingots made of alloys according to this invention. In contrast, the preparation of comparative alloys was accompanied by significant oxidation and undesirable losses of alloying elements. The ingots of both the new and the comparative alloys were then re-melted and permanent-mold-cast, obtaining bars 30 mm in diameter, which were used for the preparation of specimens for tensile, corrosion and creep tests.

The ring test and constrained rod tests were employed in order to evaluate susceptibility to hot tearing. Permanent mold cast alloys were subjected to heat treatment to obtain the best combination of mechanical properties. Tensile Yield Strength (TYS), Ultimate Tensile Strength (UTS), percent elongation (% E), impact strength and fracture toughness ($K_{1c}$) were then determined. Corrosion behavior was evaluated by the salt spray test as per ASTM Standard B-117.

The new alloys surpass commercial creep resistant alloys in ductility, impact strength and fracture toughness, and corrosion resistance. Thus, the optimal combination of low susceptibility to hot cracking, improved energy-absorption properties, corrosion resistance, and creep resistance makes new alloys particularly well tailored to permanent mold casting applications.

It was found that the new alloys can reach optimal mechanical properties after accelerated T6 heat treatment, comprising solution heat treatment at 530-570° C., preferably at 545° C., for 3 to 7 hours, preferably for 4 to 6 hours, followed by cooling in a quenching medium and by subsequent aging at 220-260° C., preferably at 250° C., for 2 to 7 hours, preferably for 3 to 4 hours.

Specifically, the present invention relates to alloys that exhibit elongation till fracture, which is a measure of ductility, not less than 10%, impact strength higher than 8 J, and fracture toughness higher than 20 $MPa.m^{0.5}$, and to alloys which exhibit minimum creep rate (MCR) less than $2.4\times10^{-10}$/s at 200° C. under stress of 90 MPa. The invention further relates to the alloys which exhibit the average corrosion rate, as measured by the salt spray test as per ASTM Standard B-117, less than 0.17 $mg/cm^2$/day. The present invention thus provides alloys, as well as articles made of these alloys, that are suitable for applications at temperatures as high as 175 to 200° C.

The invention will be further described and illustrated in the following examples.

EXAMPLES

General Procedures

The alloys of the present invention were prepared in 120 l crucible made of low carbon steel. The mixture of $CO_2$+0.5% $SF_6$ was used as a protective atmosphere. The raw materials used were as follows:

Magnesium—pure magnesium, grade 9980A, containing at least 99.8% Mg.

Zinc—commercially pure Zn (less than 0.1% impurities).

Neodymium—commercially pure Nd (less than 0.5% impurities).

Zirconium—Zr95 TABLETS, containing at least 95% Zr.

Yttrium—commercially pure Y (less than 1% impurities).

Calcium—pure Ca (less than 0.1% impurities).

Strontium—pure Sr (less than 0.1% impurities).

Beryllium—in the form of $Na_2BeF4$.

Zinc was added into the molten magnesium during the melt heating in a temperature interval 740° C. to 770° C. Intensive stirring for 2-5 min was sufficient for dissolving this element in the molten magnesium. Neodymium and zirconium were added typically at 770-780° C. After addition of zirconium, the melt was held for 20-40 minutes to allow iron to settle. Yttrium was added after the iron settling, without intensive stirring, to prevent the formation of Y—Fe intermetallic compounds, which leads to excessive loss of yttrium. A strict temperature control was provided during the alloying in order to insure that the melt temperature will not increase above 785° C., thus preventing an excessive contamination by iron from the crucible walls, and to ensure that the temperature will not decrease below 765° C., thus preventing an excessive loss of zirconium. Strontium, calcium and beryllium were added prior to settling. After obtaining the required compositions, the alloys were held for 30-60 minutes for homogenization and settling of iron and non-metallic inclusions, and then they were cast into the 15 kg ingots. The casting was performed with gas protection of the molten metal during solidification in the molds by $CO_2$+0.5% $SF_6$ mixture. The ingots of all new and comparative alloys were then remelted and permanent-mold-cast into 30 mm diameter bars, which were used for the preparation of specimens for tensile, corrosion, and creep tests. In addition, alloys prepared were cast into plates with dimensions of 40×110×150 mm that were used for corrosion and fracture toughness tests.

Permanent mold cast bars and plates were subjected to T6 heat treatment comprising solid solution treatment at 530-570° C., preferably at 545° C. for 3 to 8 hours, preferably 5 to 6 hours, followed by cooling in various quenching mediums from hot water to still ambient air, with subsequent aging at 220° C. to 260° C., preferably 250° C. for 2-6 h, preferably 3-4 hours.

Figure 3:
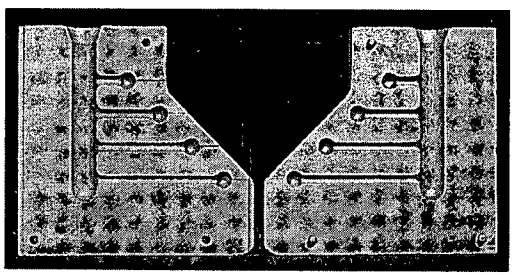
FIG. 3. shows constraint rod hot tearing mold.

Two tests, called "ring test" and "constrained rod casting" (CRC), were used in order to evaluate susceptibility to hot tearing. The ring tests were carried out using steel die with an inner tapered steel core (disk) having a variable diameter (FIG. 2). The core diameter may vary from 30 mm to 100 mm with the step of 5 mm. The test samples have the shape of flat ring with the outer diameter of 110 mm and the thickness of 5 mm. The ring width is varied from 40 mm to 5 mm with the step of 2.5 mm. The susceptibility to hot tearing was evaluated by the minimum width of the ring that can be cast without hot tear formation. The less this value the less susceptibility to hot tearing. The CRC mold (FIG. 3) has a cavity containing single runner and four rods with different lengths. Each of the rods has a T-shaped end to provide a restriction to its contraction. When metal is poured, the contraction of the rod will occur with various degrees of constraint, those with rods greater than a critical length failing by tearing at the hot spot, which is the joint between the runner and the rod. The higher the mold temperature, the greater rod length that be cast without tearing. Thus, the mold temperature allowing to cast the rods without tearing was considered as indication for susceptibility to hot tearing. These minimum CRC mold temperatures are included in Table 2 in FIG. 4.

Oxidation resistance was evaluated according to the ability of the ingots to be cast without protective atmosphere, as well as according to the dross formation. The combine ranking between 1 and 5 was set in order to estimate oxidation resistance (1 stands for the best, 5 stands for the worst).

Tensile testing at ambient was performed using an Instron 4483 machine Tensile Yield Strength (TYS), Ultimate Tensile Strength (UTS), and percent elongation (% E) were determined. The impact strength test was conducted on Tinius-Olsen Charpy machine. The ASTM E23 standard un-notched impact test sample was used for this testing. Ten samples were tested for each alloy. The SATEC Model M-3 machine was used for creep testing. Creep tests were performed at 175° C. and 200° C. for 300 h under various stresses. Creep resistance was estimated based on the value of minimum creep rate (MCR) and creep strength. Creep strength is usually defined as the stress, which is required to produce a certain amount of creep at a specific time and temperature. It is a common practice to report creep strength as the stress, which produces 0.2% creep strain at a given temperature for 100 hours. This parameter is used by design engineers for evaluating the load-carrying ability of a material for limited creep strain in prolonged time periods. Corrosion behavior was evaluated by the salt spray test as per ASTM Standard B-117. This test consisted of a 240 hrs natural salt spray in 5% NaCl solution conditions at 35° C. The specimens were shaped as plates with the 70 mm length and width the 5 mm thickness. The samples were degreased in acetone and weighed prior to the test. Five replicates of each alloy were tested. At the end of the test the corrosion products were stripped in a chromic acid solution (180 g $CrO_3$ per liter solution) at 80° C. about three minutes and the weight loss was determined. The weight loss was used to determine the average corrosion rate in $mg/cm^2$/day.

Fracture toughness test was performed as per ASTM B-646 standard.

Tables 1 to 3 illustrate chemical compositions and properties of alloys according to the invention, and alloys of comparative examples. The comparative examples 1 and 7 are commercial magnesium-based alloys ML11 (Russian designation) and ZE41, respectively. The results of hot tearing tests are listed in Table 2. It is evident that new alloys exhibit lower susceptibility to hot cracking (less ring width and significantly lower mold temperature allowing crack free casting) than comparative alloys. The results shown in table 2 (columns 4 and 5) distinctly demonstrate that new alloys outperform all comparative examples in terms of susceptibility to oxidation and burning. The melt loss for new alloys is also lower than for comparative alloys. It is a very important factor because both the new alloys and the comparative alloys contain rather expensive elements like Y, Nd, Zr and Rare Earth (RE) mishmetal. The mechanical properties of permanent mold cast alloys of this invention and comparative alloys are shown in Table 3. The new alloys are superior in ductility, impact strength and fracture toughness over the comparative alloys. Corrosion resistance of the new alloys also surpasses that property of the comparative alloys. In addition, new alloys also exhibit excellent creep resistance in the temperature range 175-200° C., outperforming most of the comparative examples.

A great advantage of the alloys of this invention is that they combine excellent creep resistance with superior ductility, impact strength and fracture toughness properties. The excellent combination of these properties along with low susceptibility to hot tearing makes the alloys of the instant invention the most attractive candidates for permanent mold casting of, for example, casting power train components such as engine cradle, rear lower control arm, etc.

While this invention has been described in terms of some specific examples, many modifications and variations are possible. It is therefore understood that, within the scope of the appended claims, the invention may be realized otherwise than as specifically described.

The invention claimed is:

1. A magnesium-based creep resistant alloy with improved ductility and fracture toughness for low pressure casting and gravity casting of low density articles, consisting of:

i) 96 wt % or more magnesium to balance components ii to viii to 100 wt %, ii) 1.5 to 1.9 wt % neodymium, iii) 0.10 to 0.30 wt % yttrium, iv) 0.35 to 0.70 wt % zirconium, v) 0.05 to 0.35 wt % zinc, vi) 0.01 to 0.10 wt % calcium vii) 0.01 to 0.15 wt % strontium, and viii) 0.000 to 0.0005 beryllium, wherein the alloy exhibits room temperature elongation to rupture not lower than 10%, impact strength not lower than 8J, and fracture toughness not lower than 21 $MPa \cdot m^{0.5}$, and wherein the alloy contains incidental impurities.

2. An alloy according to claim 1, wherein the strontium and calcium contents are each lower than 0.05 wt %.

3. An alloy according to claim 1, wherein the beryllium content is lower than 0.0003 wt %.

4. An alloy according to claim 1, exhibiting low susceptibility to hot tearing thereby enabling crack-free permanent mold casting even at temperatures as low as 300-320° C.

5. An alloy according to claim 1, exhibiting high ductility, impact strength and fracture toughness, and creep resistance in response to accelerated T6 heat treatment comprising solid solution heat treatment at 530-570° C. for 3 to 7 hours followed by cooling in a quenching medium and by subsequent aging at 220-260° C. for 2 to 7 hours.

6. An alloy according to claim 1, retaining high creep resistance up to 200° C.

7. An alloy according to claim 6, exhibiting minimum creep rate (MCR) at 200° C. under stress of 90 MPa of not more than $2.4\times10^{-10}$–$s^{-1}$.

8. An alloy according to claim 1, exhibiting average corrosion rate, measured by the salt spray test as per ASTM Standard B-117, of less than 0.17 $mg/cm^2$/day.

9. An alloy according to claim 1, suitable for applications at temperatures of up to 200° C.

10. An article which is a casting of a magnesium alloy of claim 1.

11. An article according to claim 10, wherein the casting is selected from the group consisting of permanent mold casting, low-pressure permanent mold casting, sand casting, low-pressure sand casting, investment casting, and low-pressure investment casting.

12. An article according to claim 10, which was subjected to accelerated T6 heat treatment comprising solid solution heat treatment at 530-570° C. for 3 to 7 hrs, followed by cooling in a quenching medium and by subsequent aging at 220-260° C. for 2 to 7 h.

13. An article according to claim 10, which was subjected to accelerated T6 heat treatment comprising solid solution heat treatment at 545° C. for 4 to 6 hours, followed by cooling in a quenching medium and by subsequent aging at 250° C. for 2 to 4 hours.

14. An article according to claim 10, which is suitable for applications at temperatures of up to 200° C.

* * * * *

UNITED STATES PATENT AND TRADEMARK OFFICE

CERTIFICATE OF CORRECTION

PATENT NO. : 7,718,118 B2
APPLICATION NO. : 11/525691
DATED : May 18, 2010
INVENTOR(S) : Boris Bronfin et al.

It is certified that error appears in the above-identified patent and that said Letters Patent is hereby corrected as shown below:

Title page, item [73]
Under Assignee:

delete "Dead Sea Magnesium Ltd., Beer-Sheva (IL)" and
insert --Dead Sea Magnesium Ltd., Beer-Sheva (IL)-- and
insert --Volkswagen AG, Woltsburg (DE)--

Signed and Sealed this
Twenty-fifth Day of January, 2011

David J. Kappos

David J. Kappos
*Director of the United States Patent and Trademark Office*